US007540835B2

(12) United States Patent
Micallef

(10) Patent No.: US 7,540,835 B2
(45) Date of Patent: Jun. 2, 2009

(54) METHOD AND APPARATUS FOR FLEXIBLE SHEET FOLDING

(76) Inventor: Peter Micallef, Level 15 The Business Tower, Portomaso, St. Julian's 06 (MT)

( * ) Notice: Subject to any disclaimer, the term of this patent is extended or adjusted under 35 U.S.C. 154(b) by 0 days.

(21) Appl. No.: 11/251,280

(22) Filed: Oct. 13, 2005

(65) Prior Publication Data

US 2007/0099785 A1 May 3, 2007

(51) Int. Cl.
*B31F 1/12* (2006.01)

(52) U.S. Cl. ..... 493/407; 493/456; 493/464; 493/480; 100/236

(58) Field of Classification Search ..... 493/480, 493/395, 405, 407, 419, 451, 456, 464, 439, 493/309, 311, 413, 457; 100/236, 902, 264
See application file for complete search history.

(56) References Cited

U.S. PATENT DOCUMENTS

| | | | | | |
|---|---|---|---|---|---|
| 733,700 | A | * | 7/1903 | Cohen | 493/439 |
| 945,432 | A | * | 1/1910 | Yost | 493/439 |
| 2,400,698 | A | * | 5/1946 | Lissa | 493/439 |
| 2,592,766 | A | * | 4/1952 | Tincher | 493/353 |
| 2,656,799 | A | * | 10/1953 | Hatton | 110/101 CB |
| 2,712,933 | A | * | 7/1955 | Davidson | 493/406 |
| 3,901,141 | A | * | 8/1975 | Bochmann | 100/236 |
| 4,199,873 | A | | 4/1980 | Hansen et al. | |
| 4,391,596 | A | | 7/1983 | Fischer | |
| 4,421,500 | A | * | 12/1983 | Smith | 493/405 |
| 4,475,449 | A | * | 10/1984 | Gianelo | 100/42 |
| 4,579,552 | A | * | 4/1986 | Brannlund | 493/439 |
| 4,774,780 | A | | 10/1988 | Crowell | |
| 5,094,658 | A | | 3/1992 | Smithe et al. | |
| 5,096,751 | A | | 3/1992 | Duchek | |
| 5,233,917 | A | * | 8/1993 | Handzlik | 100/232 |
| 5,259,827 | A | * | 11/1993 | Staniszewski et al. | 493/451 |
| 5,374,233 | A | | 12/1994 | Lehmann et al. | |
| 5,445,591 | A | * | 8/1995 | Fougere | 493/439 |

(Continued)

FOREIGN PATENT DOCUMENTS

JP 405245699 * 9/1993

OTHER PUBLICATIONS

English Abstract and Machine Translation of Japanese Patent 405245699, Obtained on 10/24/1007.*

(Continued)

*Primary Examiner*—Paul R Durand
(74) *Attorney, Agent, or Firm*—K&L Gates, LLP

(57) ABSTRACT

In one embodiment of the present invention, a sheet folding system is provided. The sheet folding system includes a first wall, a second wall coupled to the first wall, a third wall and a fourth wall coupled to the third wall. The walls are configurable in a first configuration in which a chamber adapted to receive a sheet is formed at least partly by the walls. The walls are also configurable in a second configuration in which the first and second walls are substantially coplanar, the third and fourth walls are substantially coplanar and the chamber is substantially collapsed. The sheet folding system can include a fastening device adapted to hold at least a portion of the sheet substantially in a desired position relative to the first wall. The sheet folding system can include a position indicator. The sheet can be a sheet of paper.

19 Claims, 13 Drawing Sheets

U.S. PATENT DOCUMENTS 5,492,269 A * 2/1996 Sung ..... 229/117.06
5,630,781 A * 5/1997 Hubbard ..... 493/438
5,692,436 A * 12/1997 Pishioneri ..... 100/137
5,802,968 A * 9/1998 Kirschner et al. ..... 100/233
5,876,320 A 3/1999 Le Compte
6,210,309 B1 4/2001 Smithe et al.
6,543,640 B2 * 4/2003 Russo ..... 221/34
6,612,433 B2 9/2003 McKenzie
6,852,073 B2 2/2005 Neumann et al.

OTHER PUBLICATIONS

Page from website www.officezone.com/folding_guide.htm, Dated Jan. 12, 2006.
Page from website www.letterfoldingmachine.com/index.html, Dated Jan. 12, 2006.

* cited by examiner

METHOD AND APPARATUS FOR FLEXIBLE SHEET FOLDING

BACKGROUND

There is often the need to fold a flexible sheet of material. For example, millions of pieces of paper are folded each workday so that the paper is folded neatly and can be completely inserted into a standard sized envelope smaller than the piece of paper for mailing or for any of a number of other reasons. For some flexible sheets of material, such as paper, it is commonplace for the folding operation to be performed entirely manually. However, particularly when the sheet is paper or of similar thickness to paper, there is the danger of cutting oneself during the entirely manual folding process.

Partly to address the issue of paper-cuts and partly to increase the speed with which large amounts of folding can be accomplished, automatic folding devices, such as the ones described in U.S. Pat. Nos. 4,391,596; 5,094,658; 5,374,233; 5,876,320; 6,210,309 and 6,852,073, were developed. However, such automatic folding devices are complicated, having several moving parts, rollers, cylinders and/or plowshares. Typically, the complexity results in more opportunities for parts of the folding device to break or malfunction, leading to a system failure. Further, the complexity results in a device that is expensive to make. Even further, such folding devices operate on electrical power, making operating the devices an additional electrical expense when energy costs are high, and making operating the devices an impossibility when the power is out.

SUMMARY

In one embodiment of the present invention, a sheet folding system is provided. The sheet folding system includes a first wall, a second wall coupled to the first wall, a third wall and a fourth wall coupled to the third wall. The first, second, third and fourth walls are configurable in a first configuration in which a chamber adapted to receive a sheet is formed at least partly by the walls. The first, second, third and fourth walls are also configurable in a second configuration in which the first and second walls are substantially coplanar, the third and fourth walls are substantially coplanar and the chamber is substantially collapsed.

The sheet folding system can include a fastening device adapted to hold at least a portion of the sheet substantially in a desired position relative to the first wall. The sheet folding system can include a position indicator adapted to facilitate positioning the sheet in the chamber such that a portion of the sheet is in a desired location after the sheet is folded. The position indicator can be a transparent or translucent section of the first wall. The position indicator can be one or more marks on the first wall.

The sheet can be a sheet of paper. Also, the first wall can include a first segment and a second segment, wherein at least part of the first segment is adapted to be within the second segment in a first telescopic position and outside of the second segment in a second telescopic position.

In another embodiment, a sheet folding system is provided. The sheet folding system includes a plurality of walls. The walls are hingedly coupled together. Further, the walls are adapted to be arranged in a first configuration in which the walls at least partly define a chamber adapted to receive a sheet. The walls are also adapted to be arranged in a second configuration in which the chamber is substantially collapsed.

The sheet folding system can also include a fastening device adapted to hold at least a portion of the sheet substantially in a desired position relative to one of the walls. The sheet folding system can include a position indicator adapted to facilitate positioning the sheet in the chamber such that a portion of the sheet is in a desired location after the sheet is folded. The position indicator can be a transparent or translucent section of one of the walls. The position indicator can be one or more marks on one of the walls.

The sheet can be a sheet of paper. One of the walls can include a first segment and a second segment, wherein at least part of the first segment is adapted to be within the second segment in a first telescopic position and outside of the second segment in a second telescopic position.

The sheet folding system can include a force imparting device adapted to exert a force to return the force imparting device to a resting position. The force imparting device can be coupled to two of said plurality of walls. Further, the force imparting device can be in the resting position when said plurality of walls are in the first configuration. The force imparting device can be a hinge.

In another embodiment, a method of folding a sheet is provided. The method includes arranging the sheet in a chamber at least partly formed by a plurality of walls and collapsing the chamber. The sheet can be paper. The method can also include holding at least a first portion of the sheet to at least one of the plurality of walls so that a second portion of the sheet is in a desired position after the sheet is folded. The plurality of walls can include at least four walls.

Additional features and advantages are described herein, and will be apparent from, the following Detailed Description and the figures.

DETAILED DESCRIPTION

Figure 1:
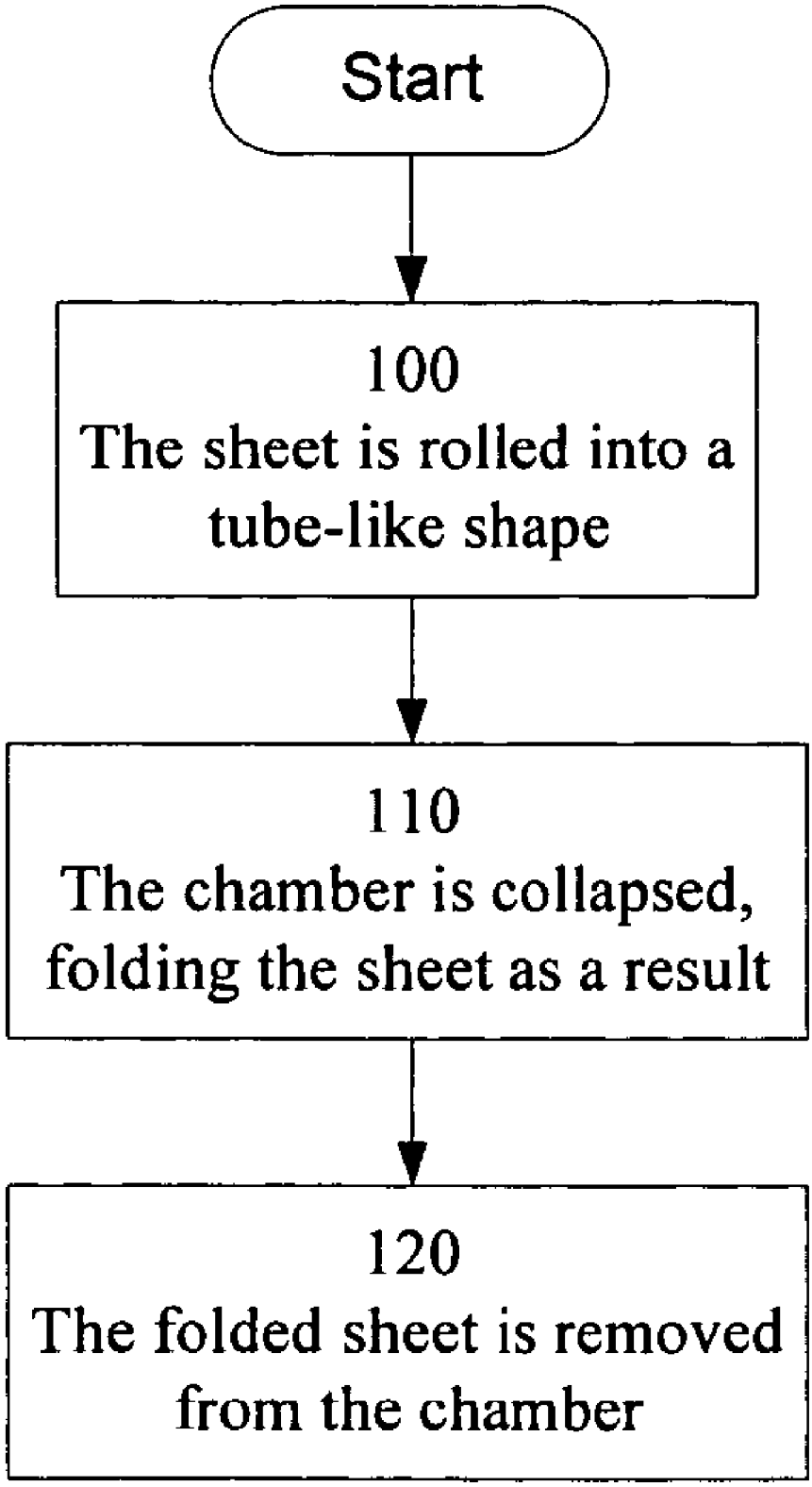
FIG. 1 is a flow diagram of the process of folding a flexible sheet in accordance with one embodiment of the present invention

In one embodiment of the present invention, a flexible sheet of material is folded by inserting the sheet into a chamber and collapsing the chamber. FIG. 1 illustrates the process of folding a flexible sheet in accordance with one embodiment of the present invention. Preferably, the sheet is rolled into a tube-like shape before insertion into the chamber as shown at step 100; however, it is not necessary to roll the sheet before, during or after insertion into the chamber and the sheet can be placed in any suitable position and/or configuration within the chamber before the chamber is collapsed. Preferably, the sheet (e.g., paper) is arranged in the chamber such that when the sheet is folded, the fold or folds are perpendicular to at least one side of the sheet, resulting in a neatly folded sheet; however, the sheet can be arranged in the chamber in any suitable manner.

At step 110, the chamber is collapsed, folding the sheet as a result. Preferably, the chamber is collapsed by manually imparting a force upon a side of the chamber; however, the chamber can be collapsed in any suitable manner. Preferably, when the chamber collapses, the interior walls of the chamber are rearranged into two substantially parallel walls of approximately equal length, thus folding portions of the sheet that overlapped in the plane of the parallel walls; however, the interior walls of the chamber can be arranged in any suitable manner upon collapse of the chamber. At step 120, the folded sheet is removed from the chamber.

One embodiment is illustrated by FIGS. 2-8. The sheet folding device 200 preferably includes four side walls 202 orthogonally connected to define a chamber 204. Preferably, the four side walls 202 each have the same lengths, widths and thicknesses; however, the four side walls 202 can have dimensions that differ from one or more of each other. Preferably, the top 206 and bottom 208 of the chamber 204 are uncovered, allowing materials to be inserted or removed from either the top 206 or bottom 208; however, either the top 206 or the bottom 208 can be closed, if desired, in any suitable manner including, but not limited to, positioning a suitable sized wall at the top 206 and/or bottom 208, and coupling the wall to one of the four side walls 202 or to a coupling device that links two or more of the four side walls 202 to each other.

Further, the four side walls 202 are preferably hingedly connected, to enable the four side walls 202 to change their relative angles, resulting in the open top 206 and bottom 208 changing from a substantially square or rectangular shape to a substantially rhombus or parallelogram shape, and further resulting in the top 206 and bottom 208 becoming substantially a line as two of the four side walls 202 are arranged to form substantially one collinear wall 210 positioned substantially adjacent to another substantially one collinear wall 214 formed by the other two of the four side walls 202; however, the four side walls 202 can be connected in any suitable manner. The hinged connection of side walls 202 is preferably made by one or more hinges; however, the side walls 202 can be connected in any suitable manner. Preferably, the hinges have a spring-back or bend-back movement capability; however, any suitable hinge or combination of hinges can be used It should be noted that the terms top, bottom and side are used for convenience only and that the walls can be arranged in any suitable orientation relative to another object or an observer.

The four side walls 202 can be any type of material including, but not limited to, cardboard, plastic, wood, metal or a combination of any suitable materials. In one embodiment, the four side walls 202 are preferably approximately 2.36 inches or 6 cm wide and approximately 8.26 inches or 21 cm long; however, the four side walls 202 can have any suitable size and/or ratio of width to length. In one embodiment, the dimensions of the box-like structure formed by the four side walls 202 are determined by the desired maximum dimensions for a folded sheet. For example, the sheet to be folded 212 is preferably paper, but can be any suitable sheet of material, and the sheet 212 may be folded by the sheet folding device 200 for the purpose of then placing the preferably neatly folded sheet in an envelope (e.g., one of several standard sized envelopes). In such circumstances, it is desirable to have the box-like structure of such size that after folding the sheet 212, the folded sheet is suitably sized for complete insertion into the envelope. Thus, the dimensions of the sheet folding device 200 may vary depending upon the desired envelope size. It should be noted that while folding of a single sheet 212 is discussed, multiple sheets can be folded in one collapse of the chamber 204, if desired. Further, multiple sheets of differing sizes can be folded in one collapse of the chamber 204. For example, two or more sheets of paper, at least two of which have different sizes, can be arranged together loosely or fastened together by a staple, paper clip, adhesive, static charge or other fastening device, placed in the chamber, and folded simultaneously and neatly as the chamber collapses, resulting in each of the sheets of paper being suitably folded for insertion into a standard sized envelope.

Figure 9:
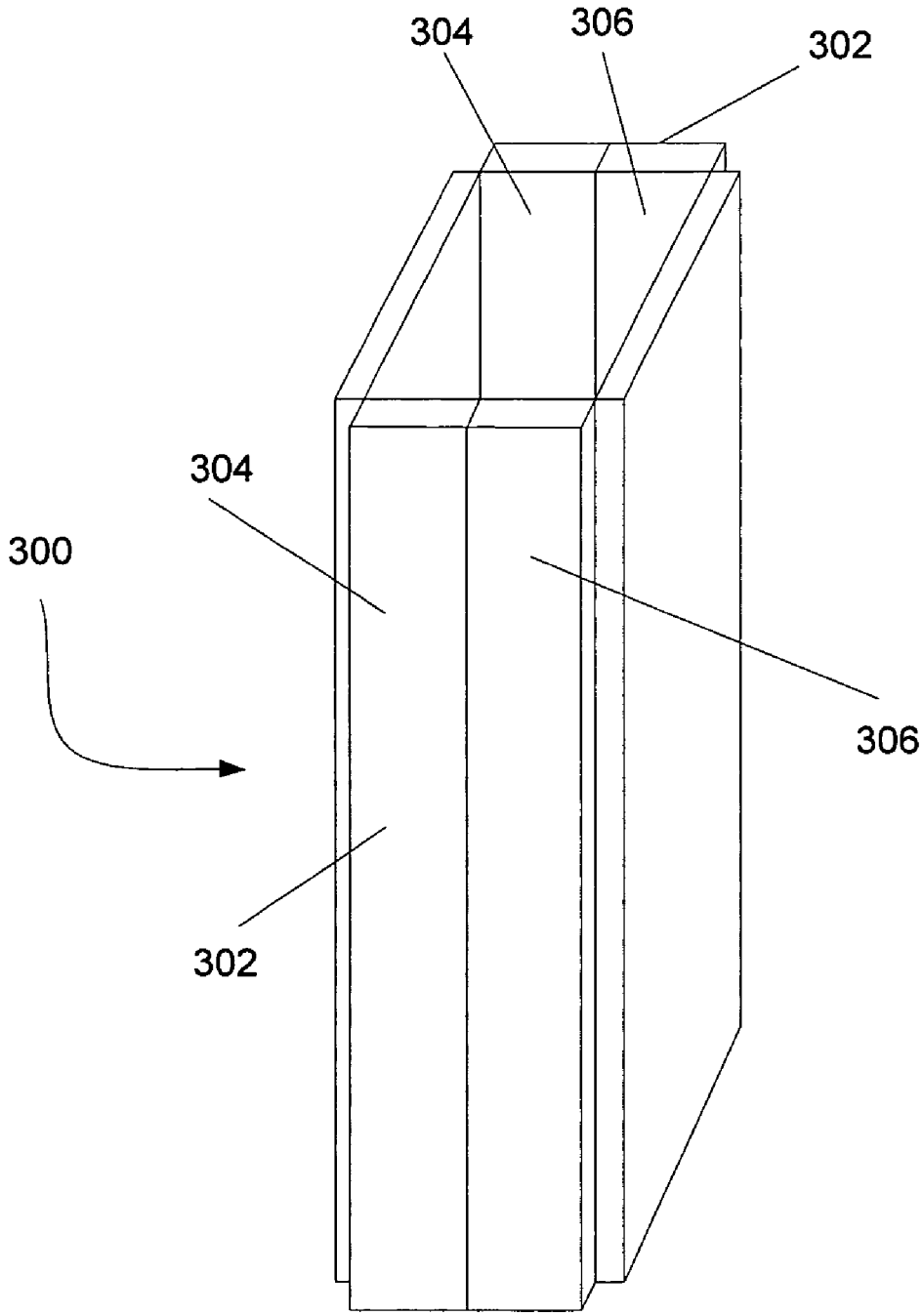
FIG. 9 is a diagram of a sheet folding device with telescopic sides in accordance with one embodiment of the present invention.
Figure 10:
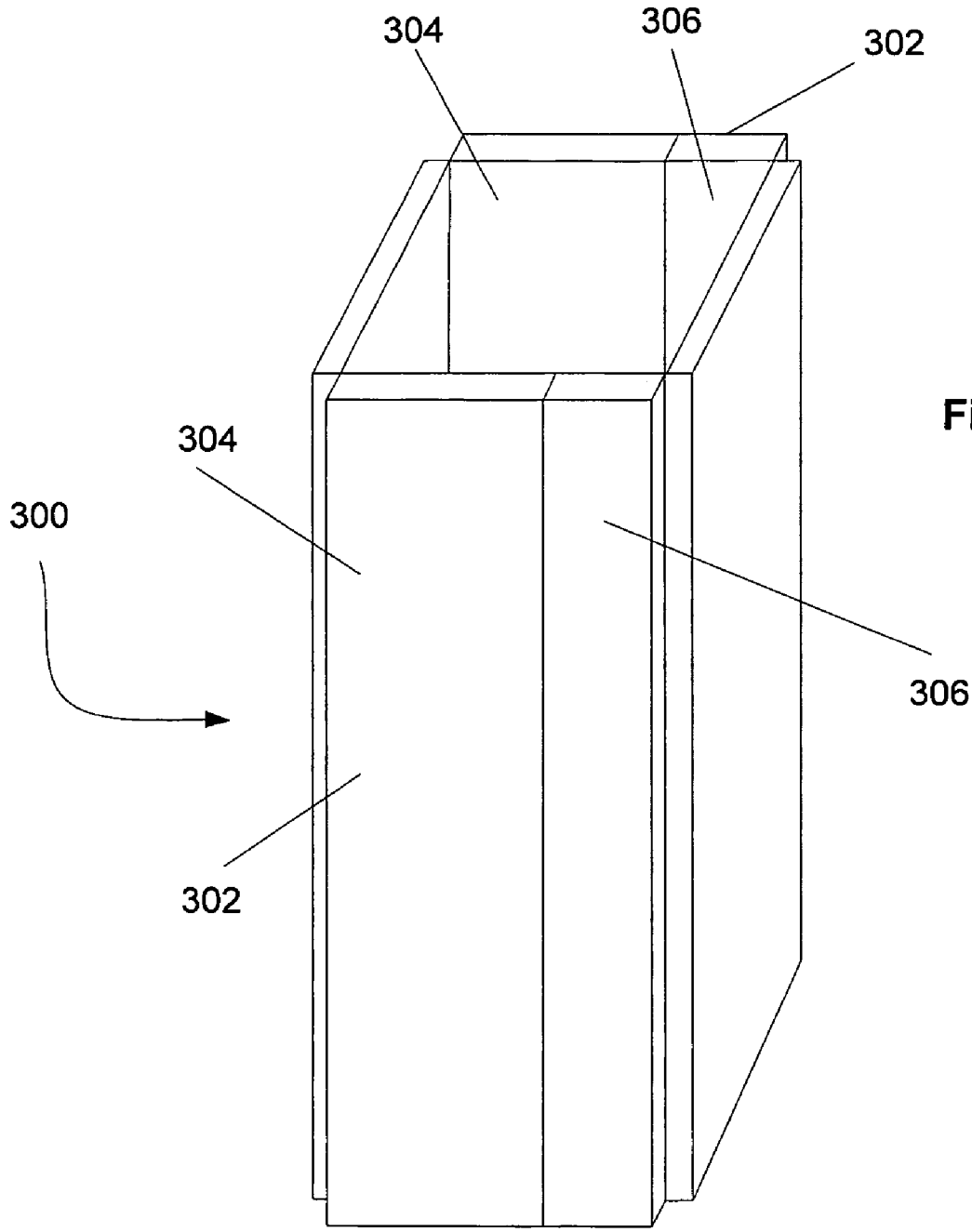
FIG. 10 is a diagram of the sheet folding device of FIG. 9, wherein two sides are positioned to elongate the sheet folding device.

Accommodation of multiple sizes of envelopes is preferably accomplished by having two or more sheet folding devices 200 which are of different, fixed sizes. However, accommodation of multiple sizes of envelope can be accomplished in any suitable manner including, but not limited to, having one or more of the side walls 202 be of variable width and/or length. FIGS. 9-10 illustrate a sheet folding device 300 having at least one variable width side wall 302. The structure and operation of the sheet folding device 300 is similar to that of sheet folding device 200; however side walls 302 are telescopic. Preferably, a side wall is made telescopic by forming the wall of at least two members, an inside member 304 and an outside member 306. A portion of the inside member 304 is positioned substantially inside of a portion of outside member 306. When at a minimum width position as shown in FIG. 9, the maximal amount of inside member 304 is covered by outside member 306. However, the two members can be repositioned, as shown in FIG. 10, preferably by sliding but any suitable manner of repositioning can be used, such that less of inside member 304 is enclosed by outside member 306, resulting in a longer total width of the wall formed by the members.

Preferably, the two members are prevented from separating completely, however the two members can be separable, if desired. Preferably, when the two members are being repositioned, a user can identify the correct position for the desired envelope size. Preferably, the members have one or more stopping positions in which the members are more resistive of relative movement to both indicate the correct position for the desired envelope size (e.g., one of several standard envelope sizes) and/or to prevent the members from slipping out of the desired position; however, the user can identify the correct position by visual markers or in any other suitable manner.

Figure 2:
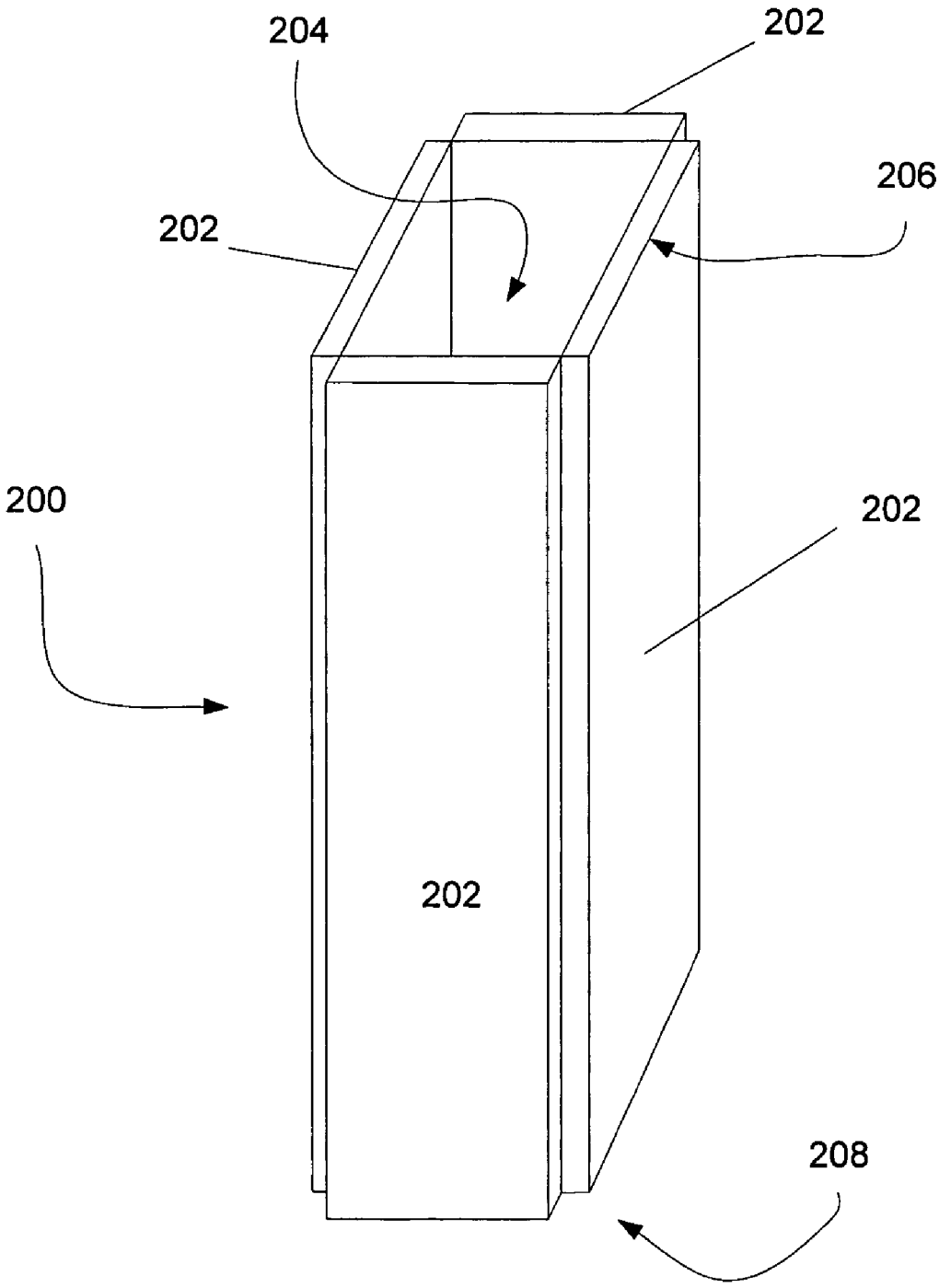
FIG. 2 is a diagram of a sheet folding device in accordance with one embodiment of the present invention.

The process of folding a sheet preferably begins with chamber 204 substantially vacant and sides walls 202 arranged substantially orthogonally, as shown in FIG. 2; however, the chamber need not be vacant and the side walls 202 can be arranged in any suitable configuration. The sheet 212 is preferably rolled into a tube-like shape; however, the sheet can be arranged in any suitable configuration. Further, the sheet 212 can be folded together with one or more additional sheets or can be folded alone. The additional sheets can be rolled or otherwise configured loosely with the sheet 212 or the additional sheets can be secured to the sheet 212 with a staple, clip or in any other suitable manner.

Figure 3:
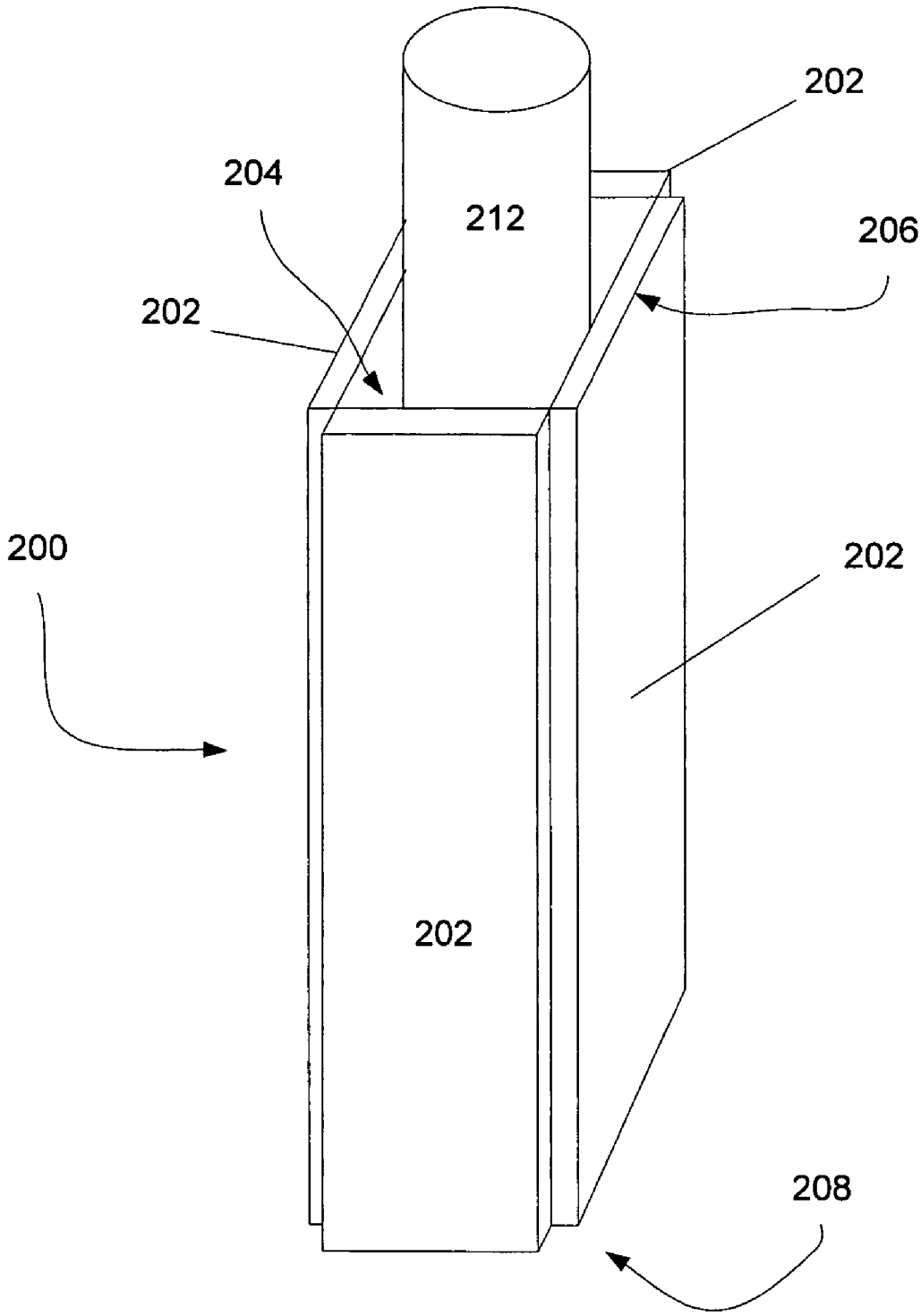
FIG. 3 is a diagram of the sheet folding device of FIG. 2 with a sheet partly inserted.
Figure 4:
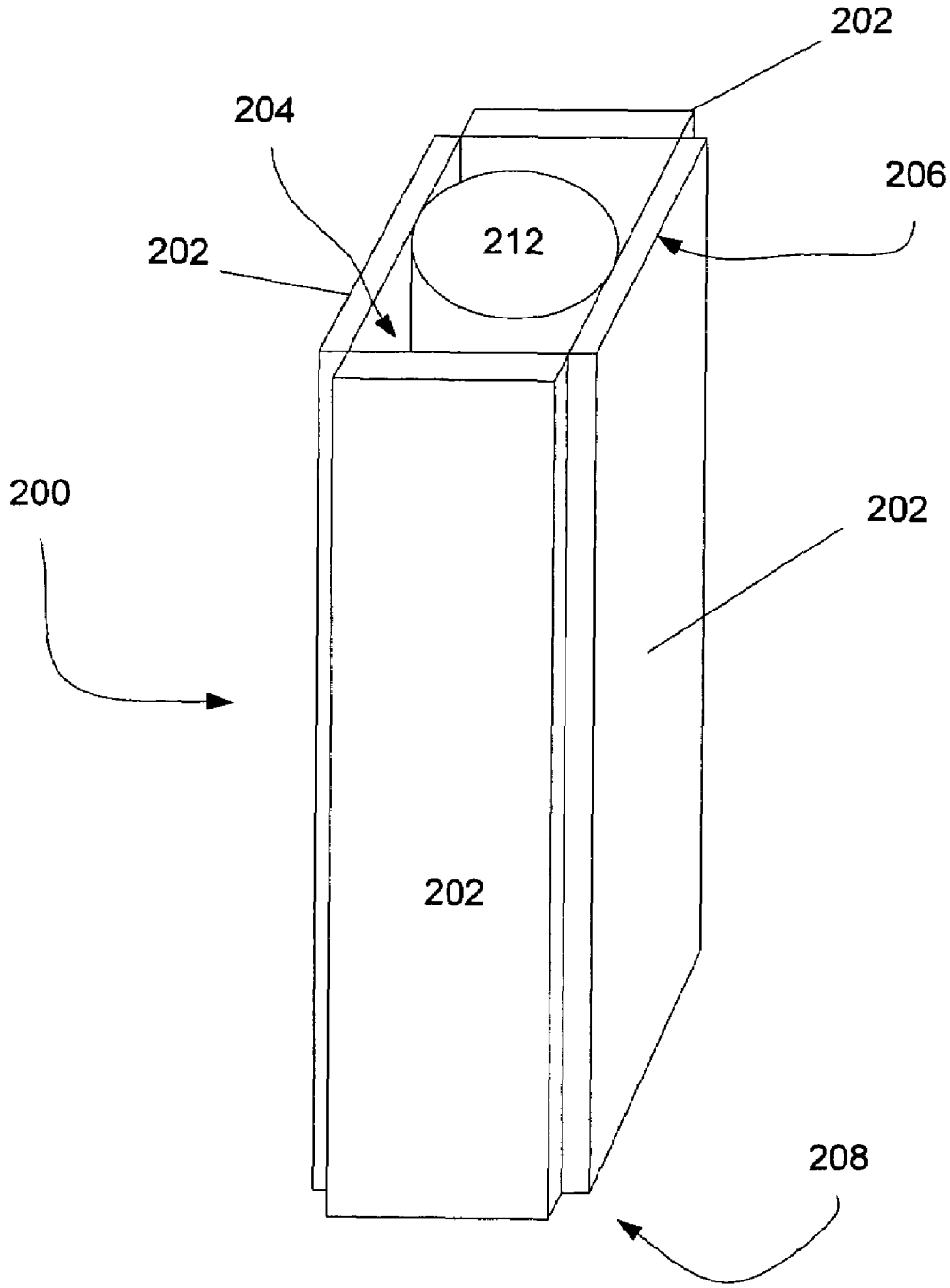
FIG. 4 is a diagram of the sheet folding device of FIG. 2 with a sheet fully inserted.
Figure 5:
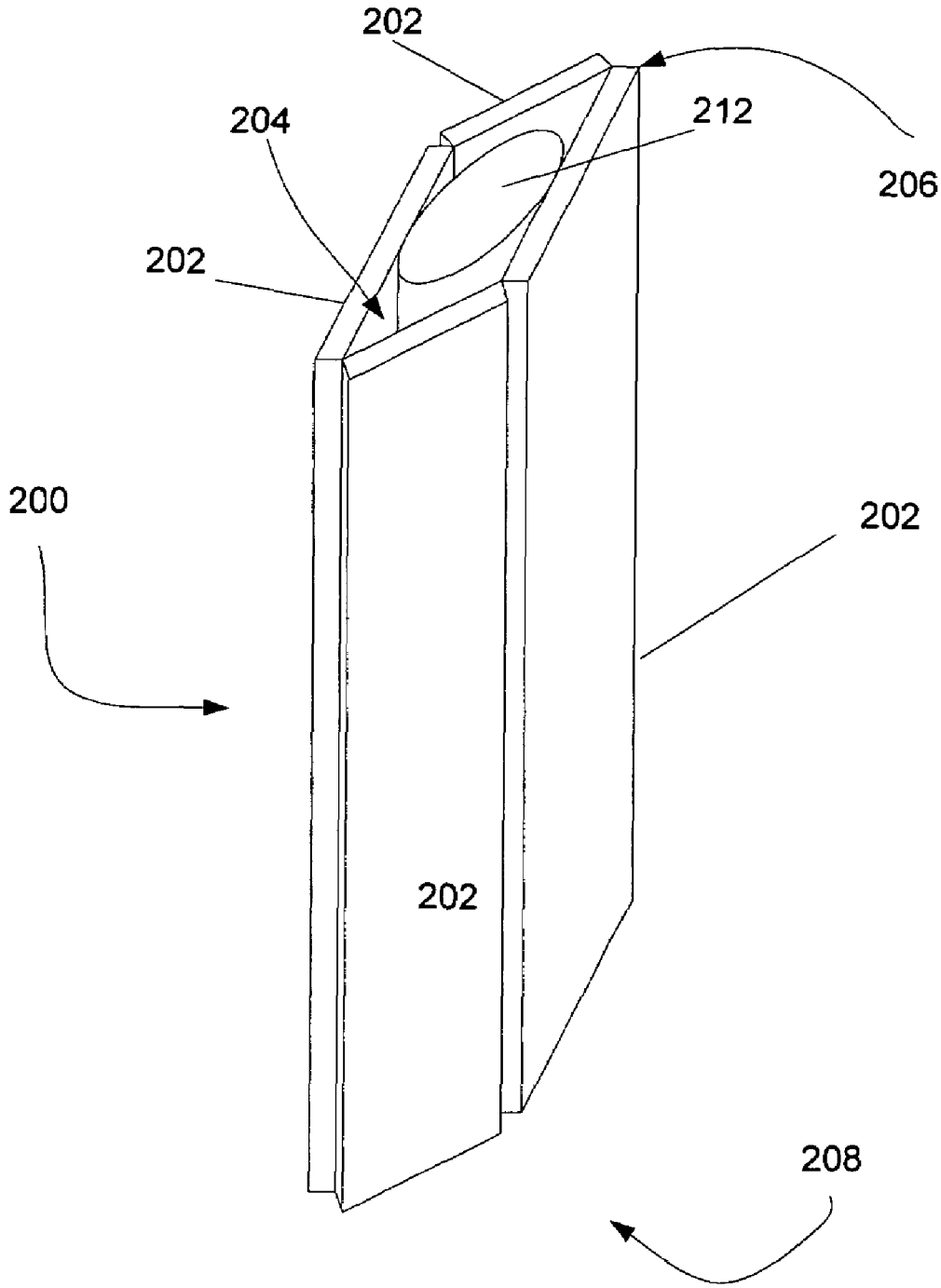
FIG. 5 is a diagram of the sheet folding device of FIG. 2, wherein the walls are repositioned to partly collapse the interior chamber.
Figure 6:
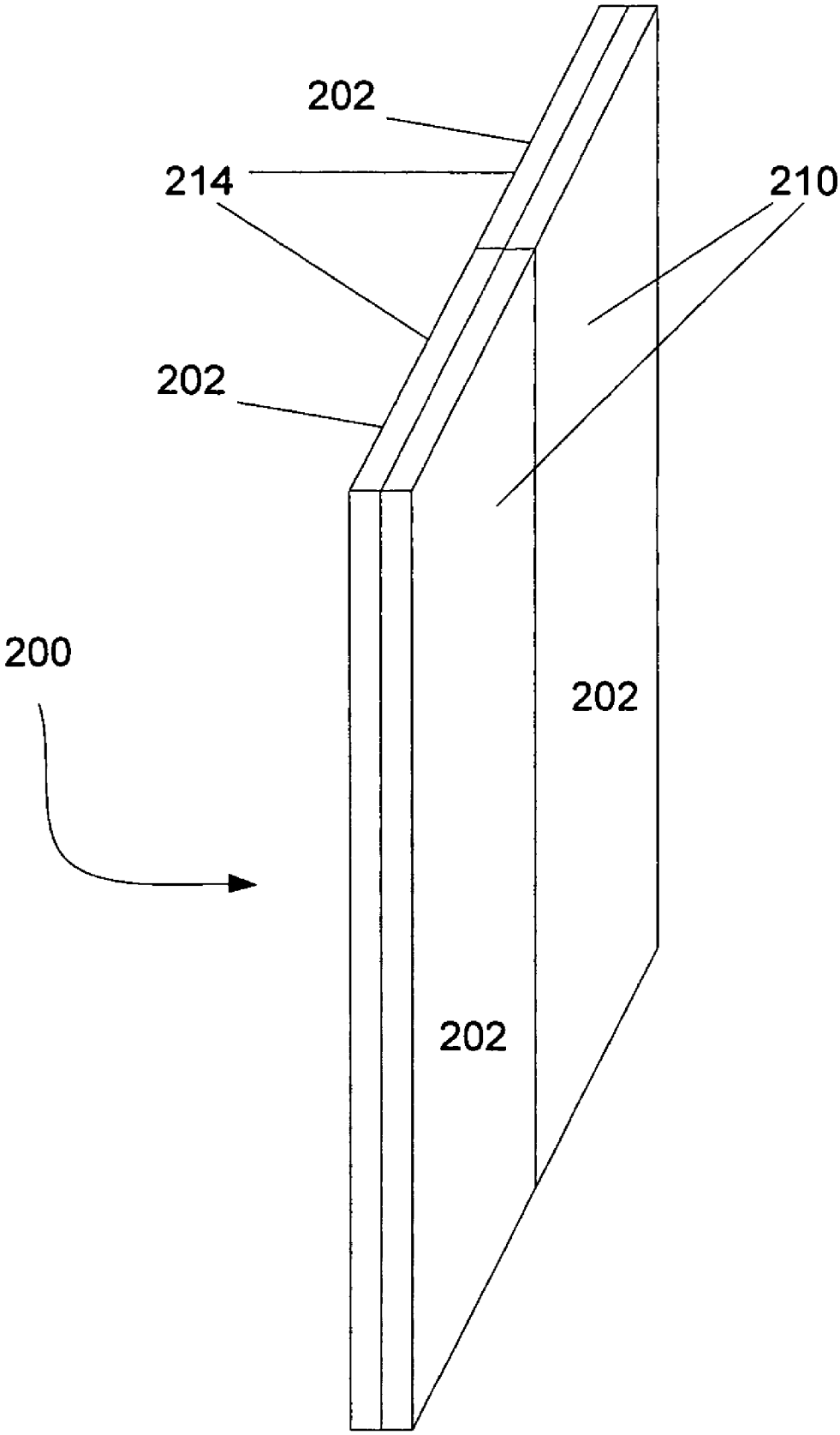
FIG. 6 is a diagram of the sheet folding device of FIG. 2, wherein the walls are repositioned to collapse the interior chamber.
Figure 7:
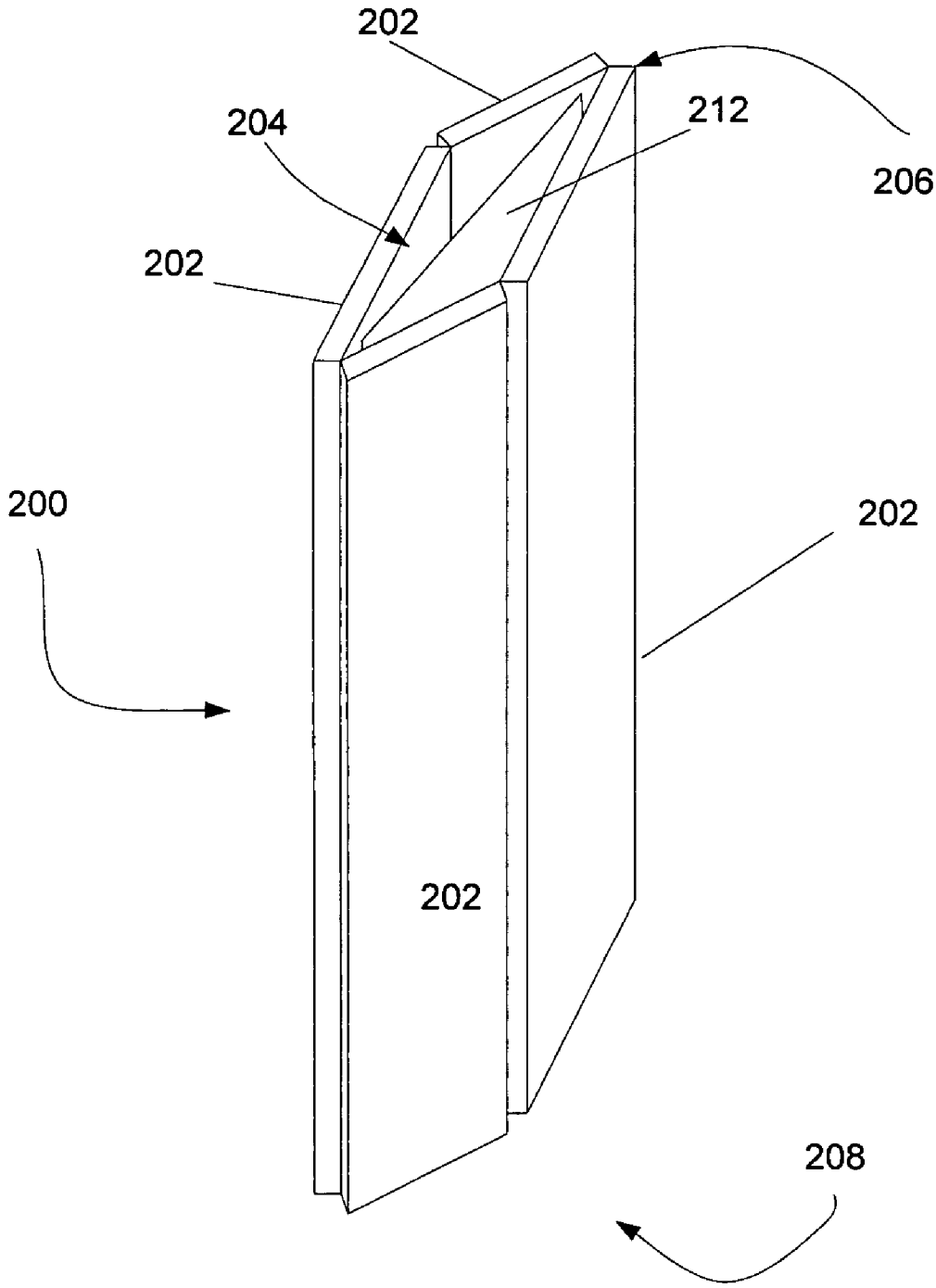
FIG. 7 is a diagram of the sheet folding device of FIG. 2, wherein the walls are returned to their original position.
Figure 8:
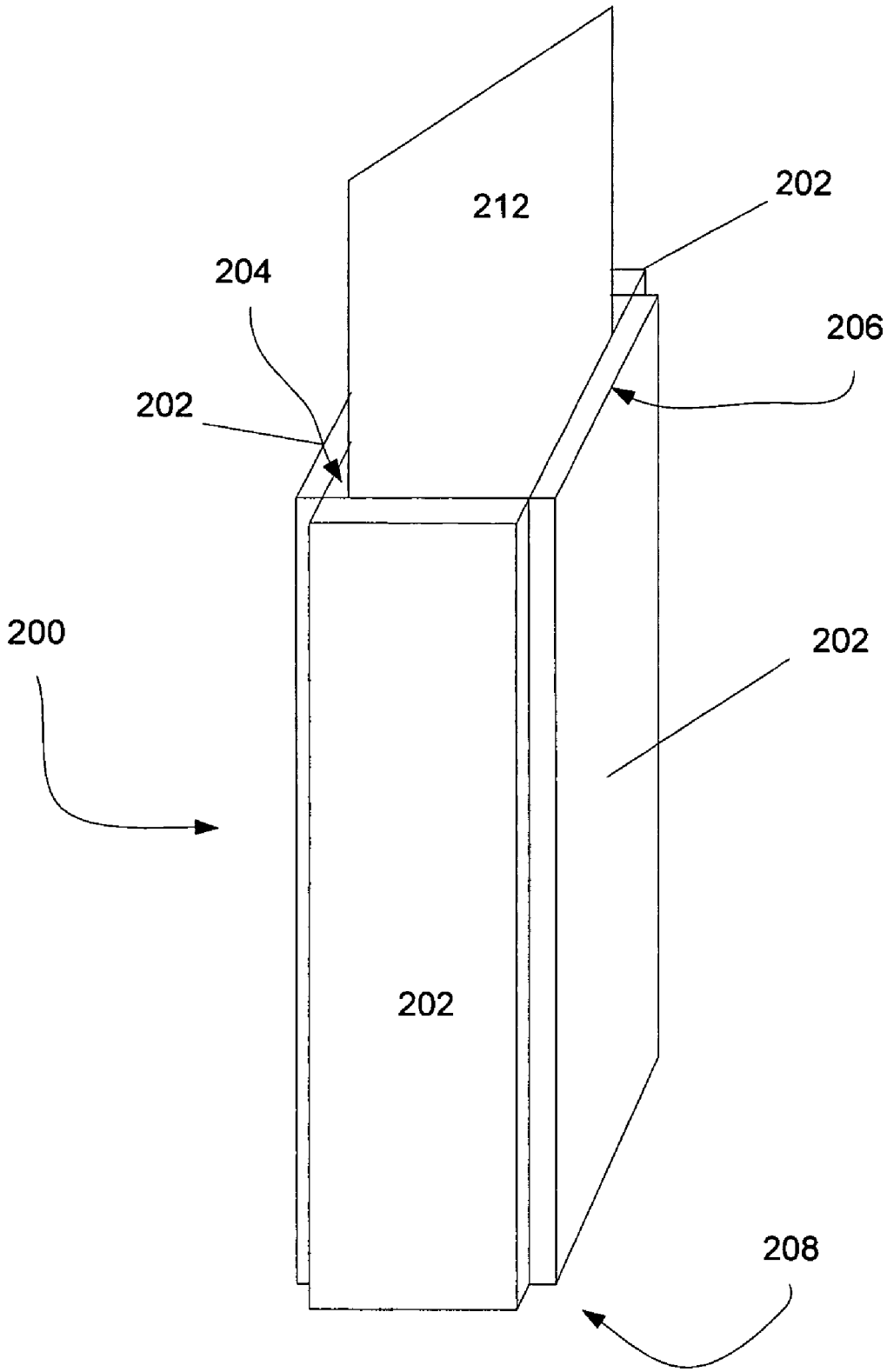
FIG. 8 is a diagram of the sheet folding device of FIG. 2 with the folded sheet partly removed.

The rolled sheet 212 is placed within the chamber 204, as shown in FIGS. 3-4. The sheet folding device 200 is preferably oriented with the top side 206 up; however, the sheet folding device 200 can be arranged in any suitable manner. With the sheet 212 arranged in the chamber 204, force is applied to at least one of the side walls 202. The side walls 202 move through the configuration shown in FIG. 5 to the configuration shown in FIG. 6. As a result, the chamber 204 collapses and the sheet 212 is folded. The side walls 202 are next moved back towards the original orthogonal position as shown in FIG. 7, and the folded sheet 212 can be removed from the sheet folding device 200 as shown in FIG. 8.

Figure 11:
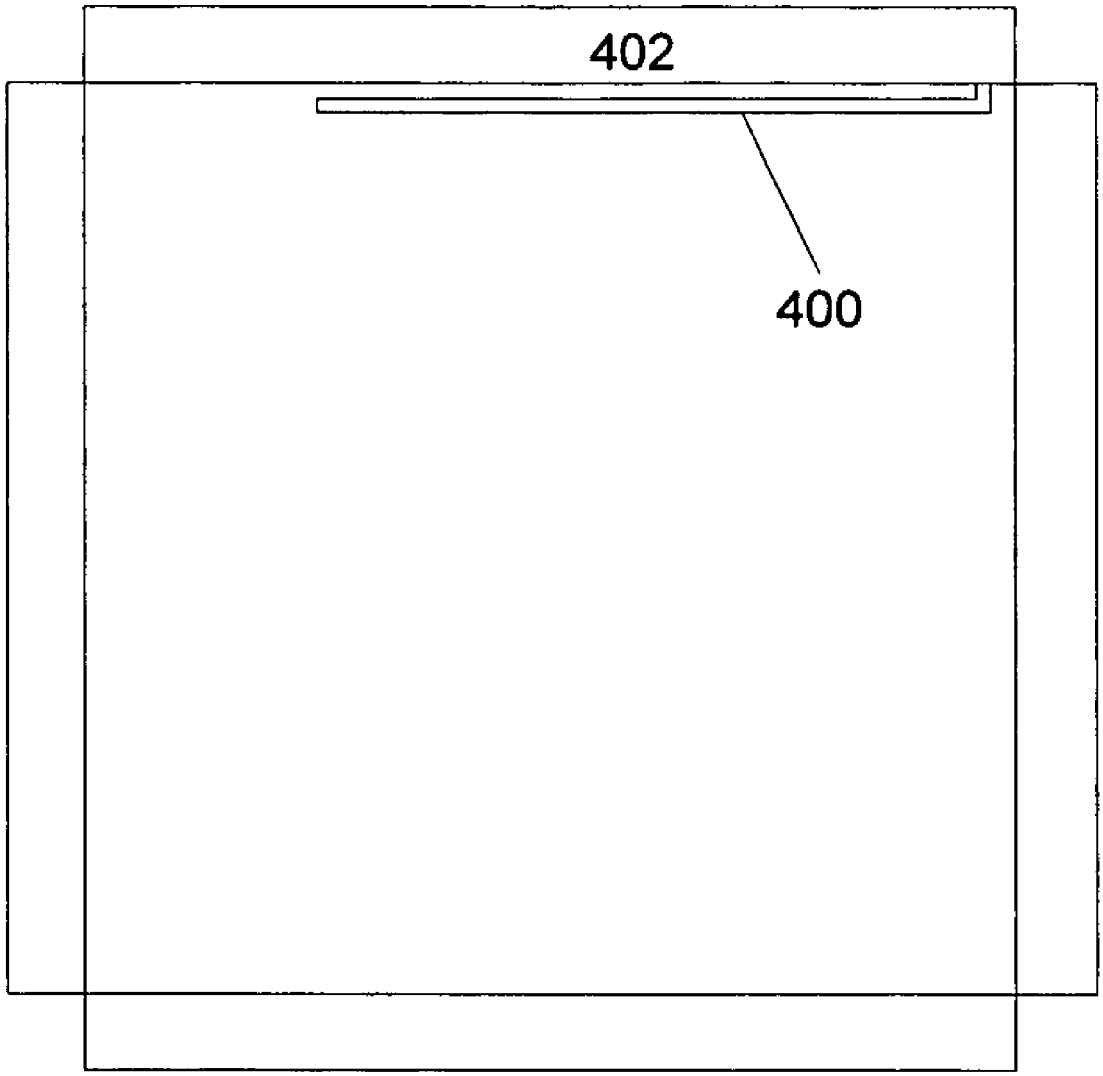
FIG. 11 is a diagram of a sheet folding device having a fastening device in accordance with one embodiment of the present invention.

FIG. 11 illustrates an optional fastening device 400 used to hold at least a portion of the sheet to be folded in a desired location during the folding process. The fastening device 400 is illustrated as a single clip running along the top side of one of the side walls 402; however, the fastening device 400 can be a slot within the side wall 402 for receiving a portion of the sheet or any other suitable device or devices for holding at least a portion of the sheet in a desired location. Further, the fastening device 400 is illustrated as being non-removeably fixed to the side wall 402; however, the fastening device 400 can be removeably attached to the side wall 402, if desired.

Figure 12:
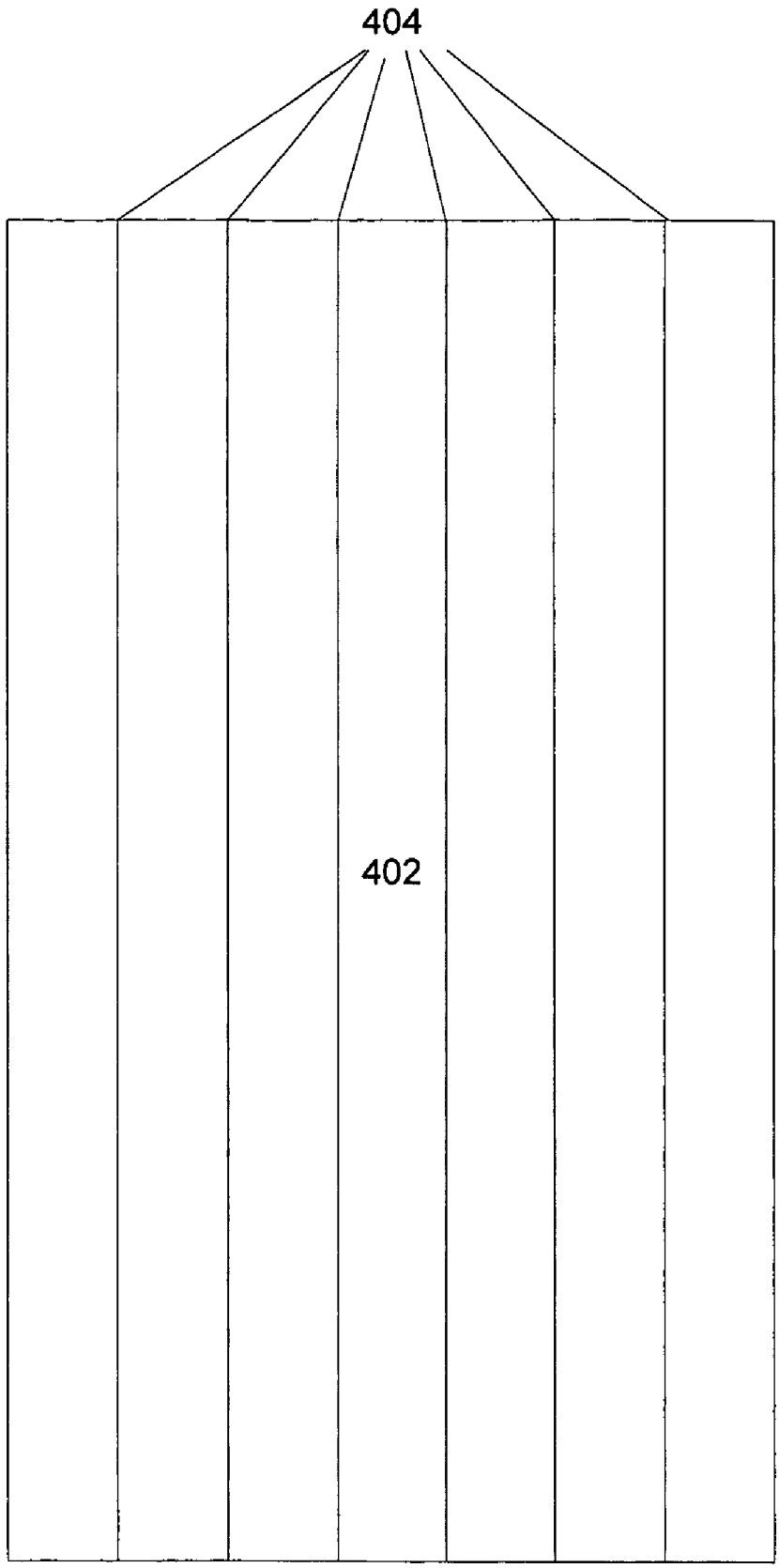
FIG. 12 is a diagram of a side wall of the sheet folding device of FIG. 12.

As shown in FIG. 12, the side wall 402 can include positioning indications 404 to assist with positioning the sheet within the chamber. Preferably, the side wall 402 is transparent or translucent, allowing the sheet to be viewed through the side wall 402; however, one or more portions of the side wall 402 can be transparent or translucent with other portions being opaque or the side wall can be entirely opaque or have any other suitable light transmitting properties. It should be noted that while the positioning indications 404 are shown in conjunction with the side wall 402 having a fastening device 400, a fastening device 400 can be present without positioning indications 404 and positioning indications 404 can be present without a fastening device 400.

Figure 13:
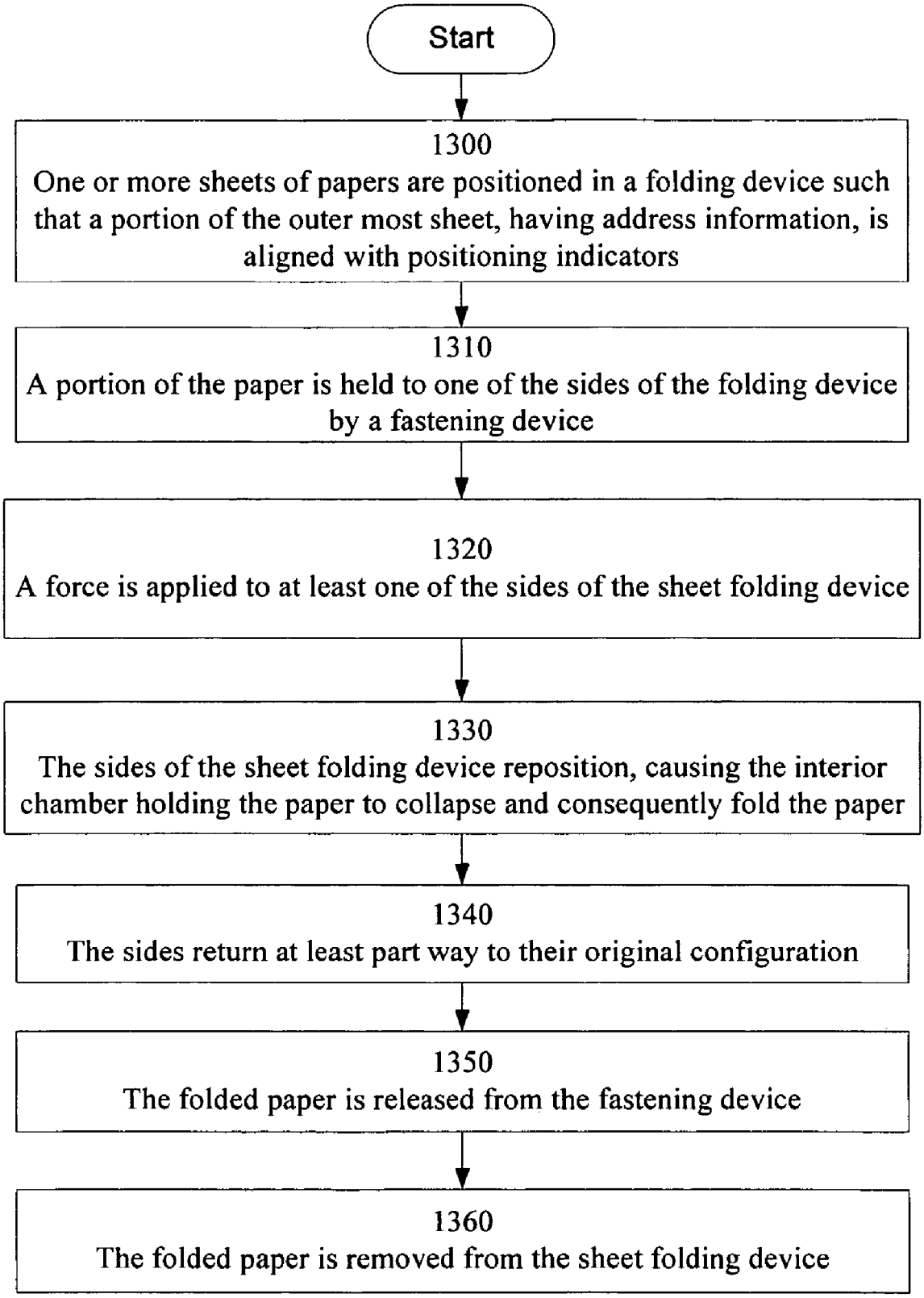
FIG. 13 is a flow diagram of the process of folding one or more sheets of paper in accordance with one embodiment of the present invention.

FIG. 13 illustrates the process of folding one or more sheets of paper in accordance with one embodiment of the present invention. At step 1300, the one or more sheets of papers are positioned in the folding device such that a portion of the outer most sheet, having address information, is aligned with positioning indicators. The indicators are configured such that when paper is folded in accordance with the indicators, the portion having the address information will be aligned with a transparent viewing window when inserted into the desired envelope. At step 1310, a portion of the paper is held to one of the sides of the folding device by a fastening device. The portion is held so that the paper does not slip out of alignment with the positioning indicators during folding.

At step 1320, a force is applied to at least one of the sides of the sheet folding device. At step 1330, the sides of the sheet folding device reposition, causing the interior chamber holding the paper to collapse and consequently fold the paper. At step 1340, the sides return at least part way to their original configuration. The sides preferably return at least part way to their original configuration because at least one of the hinges provides enough force one the collapsing force is removed to cause the sides to move; however, the sides can move due to manually applied force or due to any other suitable cause. At step 1350, the folded paper is released from the fastening device, and at step 1360, the folded paper is removed from the sheet folding device. The folded paper is then ready for insertion into an envelope such that the address on the paper is viewable from the transparent or translucent window of the envelope when the folded paper is completely inserted.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of folding a sheet comprising:

arranging the sheet in a chamber at least partly formed by a plurality of walls, wherein the plurality of walls are hingedly coupled together, wherein the plurality of walls are adapted to be arranged in a first configuration in which the plurality of walls at least partly define a chamber adapted to receive a sheet, wherein the plurality of walls are also adapted to be arranged in a second configuration in which the chamber is substantially collapsed, wherein one of said plurality of walls includes a first segment and a coplanar second segment, wherein at least part of the first segment is adapted to be within the second segment in a first telescopic position, outside of the second segment in a second telescopic position, and the first and second telescopic positions are coplanar;

removably attaching at least a first portion of the sheet relative to at least one of the plurality of walls before collapsing the chamber such that the first portion remains removably attached relative to the at least one wall at least partially while the chamber is collapsed; and collapsing the chamber.

2. The method of claim 1, wherein the sheet is paper.

3. The method of claim 1, wherein removably attaching the first portion of the sheet causes a second portion of the sheet to be in a desired position after the sheet is folded.

4. The method of claim 1, wherein the plurality of walls includes at least four walls.

5. The method of claim 1, wherein removably attaching includes clipping the first portion of the sheet to the at least one of the plurality of walls.

6. The method of claim 1, wherein a crease is formed in the sheet from a first edge of the sheet to a second edge of the sheet, the first edge being opposite the second edge, when the chamber is collapsed.

7. A sheet folding system comprising:

a first wall having a first interior surface, wherein said first wall includes a first segment and a second segment, wherein at least part of the first segment is adapted to be within the second segment in a first telescopic position and outside of the second segment in a second telescopic position, wherein the first segment is slideable relative to the second segment between the first telescopic position and the second telescopic position;

a second wall having a second interior surface coupled to said first wall, wherein a first side of the first wall is coupled to a first side of the second wall without any intervening wall between the first side of the first wall and the first side of the second wall;

a third wall having a third interior surface;

a fourth wall having a fourth interior surface coupled to said third wall, wherein a first side of the third wall is coupled to a first side of the fourth wall without any intervening wall between the first side of the third wall and the first side of the fourth wall, wherein said first wall, said second wall, said third wall and said fourth wall are configurable in a first configuration wherein a chamber adapted to receive a sheet is formed at least partly by said first wall, said second wall, said third wall and said fourth wall in the first configuration, and wherein said first wall, said second wall, said third wall and said fourth wall are also configurable in a second configuration wherein a first plane is substantially parallel to the first interior surface and the second interior surface and passes through said first wall and said second wall in the second configuration and a second plane is substantially parallel to the third interior surface and the fourth interior surface and passes through said third wall and said fourth wall in the second configuration and wherein the chamber is substantially collapsed in the second configuration; and at least one position indicator formed from at least a portion of at least one of said walls, wherein the position indicator is adapted to indicate the proper placement of the sheet in the chamber such that at least a portion of the sheet is in a predetermined position after the sheet is folded.

8. The sheet folding system of claim 7, further comprising:

a fastening device adapted to hold at least a portion of the sheet substantially in a predetermined position relative to said first wall.

9. The sheet folding system of claim 7, wherein said position indicator is formed in at least a portion of a transparent or translucent section of said first wall.

10. The sheet folding system of claim 7, wherein said position indicator further includes one or more marks on said first wall.

11. The sheet folding system of claim 7, wherein the sheet is a sheet of paper.

12. A sheet folding system comprising:

a plurality of walls, wherein the plurality of walls are hingedly coupled together, wherein the plurality of walls are adapted to be arranged in a first configuration in which the plurality of walls at least partly define a chamber adapted to receive a sheet, and wherein the plurality of walls are also adapted to be arranged in a second configuration in which the chamber is substantially collapsed, wherein in the second configuration, a first wall and a second wall are substantially co-planar, wherein the first wall and the second wall are substantially adjacent to each other, in the first configuration, wherein in the second configuration, a third wall and a fourth wall are substantially co-planar, wherein the third wall and the fourth wall are substantially adjacent to each other, in the first configuration, and wherein one of said plurality of walls includes a first segment and a coplanar second segment, wherein at least part of the first segment is adapted to be within the second segment in a first telescopic position, outside of the second segment in a second telescopic position, and the first and second telescopic positions are coplanar.

13. The sheet folding system of claim 12, further comprising: a fastening device adapted to hold at least a portion of the sheet substantially in a desired position relative to one of said plurality of walls.

14. The sheet folding system of claim 12, further comprising:

a position indicator adapted to facilitate positioning the sheet in the chamber such that a portion of the sheet is in a desired location after the sheet is folded.

15. The sheet folding system of claim 14, wherein said position indicator is a transparent or translucent section of one of said plurality of walls.

16. The sheet folding system of claim 14, wherein said position indicator is one or more marks on one of said plurality of walls.

17. The sheet folding system of claim 12, wherein the sheet is a sheet of paper.

18. The sheet folding system of claim 12, further comprising:

a force imparting device adapted to exert a force to return said force imparting device to a resting position, wherein said force imparting device is coupled to two of said plurality of walls, and wherein said force imparting device is in the resting position when said plurality of walls are in the first configuration.

19. The sheet folding system of claim 18, wherein said force imparting device is a hinge.

* * * * *